US006536148B2

(12) United States Patent
Heiliger

(10) Patent No.: US 6,536,148 B2
(45) Date of Patent: Mar. 25, 2003

(54) PICTURE FRAME DISPLAY UNIT METHOD AND APPARATUS

(76) Inventor: Renette Heiliger, 78 Sudden Valley, Bellingham, WA (US) 98226

( * ) Notice: Subject to any disclaimer, the term of this patent is extended or adjusted under 35 U.S.C. 154(b) by 0 days.

(21) Appl. No.: 09/809,894

(22) Filed: Mar. 15, 2001

(65) Prior Publication Data

US 2002/0129529 A1 Sep. 19, 2002

(51) Int. Cl.[7] ..... A47G 1/06
(52) U.S. Cl. ..... 40/721; 40/734; 40/765
(58) Field of Search ..... 40/721, 734, 757, 40/765, 766, 775, 776, 779

(56) References Cited

U.S. PATENT DOCUMENTS

| | | | | | |
|---|---|---|---|---|---|
| 29,652 | A | | 8/1860 | Maltby | |
| 435,388 | A | | 9/1890 | Bolton | |
| 2,329,007 | A | * | 9/1943 | Simon et al. | 40/733 |
| 2,490,638 | A | | 12/1949 | Kubec | |
| 2,649,799 | A | * | 8/1953 | Spertus | 40/721 |
| 3,460,282 | A | * | 8/1969 | Swirsky | 40/731 |
| 3,771,244 | A | * | 11/1973 | Ebner | 40/721 |
| 4,271,618 | A | | 6/1981 | Lyman | |
| 4,275,517 | A | * | 6/1981 | Blanchard | 40/124.06 |
| 4,423,563 | A | | 1/1984 | Ondricek | |
| 4,830,404 | A | * | 5/1989 | Lu | 40/729 |
| 5,005,869 | A | * | 4/1991 | Smith | 40/721 |
| 5,283,967 | A | * | 2/1994 | Abrams | 40/773 |
| 5,887,373 | A | | 3/1999 | Byers | |

* cited by examiner

*Primary Examiner*—S. Joseph Morano
*Assistant Examiner*—Jason R. Bellinger
(74) *Attorney, Agent, or Firm*—Robert B. Hughes; Hughes Law Firm, PLLC

(57) ABSTRACT

A picture frame adapted to hold pictures in a stored position and with minimal effort and time convert the pictures in the stored position to a presentation position for viewing.

10 Claims, 5 Drawing Sheets

PICTURE FRAME DISPLAY UNIT METHOD AND APPARATUS

FIELD OF THE INVENTION

The invention relates to picture frames, specifically frames that are adapted to store photos internally while displaying other photos where the photos in the stored position can be displayed with little time or effort.

1. Background

The invention relates to picture display frames namely for photographs and more particularly a method of displaying and storing pictures in a single piece unit. Personal photographs are often desired to be displayed in homes and establishments. Normally people have more photographs in their possession than room for displaying them or only a few are desired to be displayed at a given time. Thus, it is necessary to store photographs in a manner that people can easily retrieve them and display them with ease.

For example, oftentimes people have seasonal pictures corresponding to four sets of pictures of spring)summer, fall and winter. The set of pictures that is displayed must be changed four times a year to correspond to the present season. Oftentimes people find perfect locations in a house for particular pictures. Then at the end of the season the pictures must be removed from the conventional frame, transported to a storage location, a new seasonal picture is retrieved, the new picture is loaded into the conventional frame and finally the conventional frame is mounted back onto the wall. The replace picture now must be stored at a presumably distant location. Furthermore there is no indexing system to know the previous location of the picture that is now in storage.

The invention is an improved picture frame that stores pictures not in use and is easy to manufacture and simple to use. The picture frame in the preferred form, comprises two leafs and a base. On each side of the leaf is photo holding portion that comprises a transparent sheet and an opening. Each side of a leaf has a photo holding portion where there is a total of four photo holding portions. The invention is designed to display one photo at a time. The other three photos are concealed within the frame itself.

The present invention removes the need of removing a picture from a conventional frame and storing it at a somewhat distant location. But rather, employing the present invention a person can change the presently displayed picture and simultaneously store the previously displayed picture all within the same unit.

Therefore it is an object of the invention to provide a picture frame that discretely stores pictures while displaying only one and where the frame is relatively thin and remains attractive and aesthetically pleasing It is further an object of the current invention to provide a picture frame that can conveniently change its currently displayed picture. Where the picture to be displayed is stored within the frame and the currently displayed picture is stored within the display.

It is still further an object of the present invention to provide a design that is inexpensive to manufacture and aesthetically pleasing to the eye.

Other advantages to the present invention will become apparent in the detailed description below.

2. Background Art

A search of the patent literature has a number of patents directed toward these problems, these being the following:

The prior designs of picture frames are geared to display multiple pictures at a time. Further, the prior art discloses multiple discrete piece designs to manufacture the picture frames.

U.S. Pat. No. 5,887,373 Byers shows a card display frame that is assembled from multiple pieces. There is no teaching of using the display to store pictures. Further the frame in Byers is not adapted to be mounted on a wall with an attachment system to hold the frame assemblies together.

SUMMARY OF THE INVENTION

The invention is a frame that is adapted to house more than one picture where the frame has a first leaf member that has a first lateral region in a second lateral region. The first leaf has a connection region that is located in the first lateral region. The first leaf also has a first and second side positioned on opposite sides of one another on the first leaf and each side is adapted to mount a picture.

The frame further has a second leaf that has a first lateral region in a second lateral region. The second leaf is pivotally connected at a connection region located in the first lateral region to the first leaf about a transverse axis. The second leaf further has a third and fourth sides that are located on opposite sides of the second leaf and are each adapted to mount pictures thereon. The frame has a first position where the first and third sides of the first and second leafs are positioned in a face to face engagement and the second lateral regions of the first and second leafs are positioned in proximity to one another. The second or fourth pictures on either the second or fourth sides are adapted to be presented. The first and third pictures are in a stored position. The frame further having a second position where the second and fourth sides of the first and second leafs are positioned in a face to face engagement and the second lateral members of the first and second leafs are positioned in proximity to one another and the first or third pictures are adapted to be presented and the second and fourth pictures are in a stored position.

DETAILED DESCRIPTION OF THE PREFERRED EMBODIMENT

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

Figure 1:
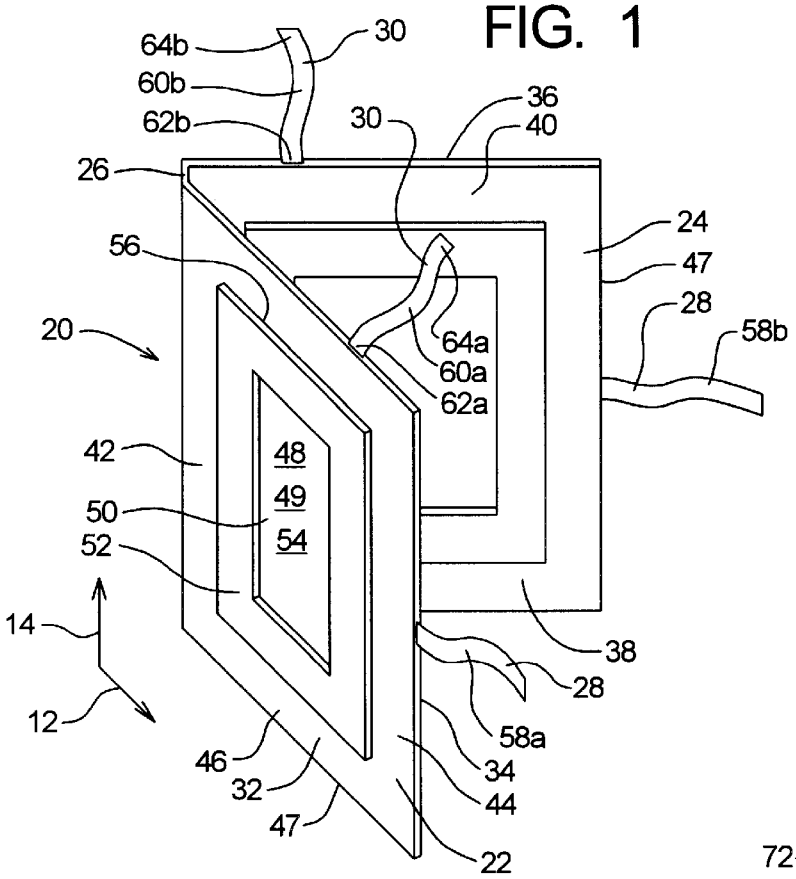
FIG. 1 shows an oblique view of the preferred embodiment of the present invention.

To aid the description, an axis system is defined whereas shown in FIG. 1, the arrow indicated at 12 indicates a lateral axis and points in an outward direction. Each leaf 22 and 24 has its own lateral axis that extends substantially in the plane of the material comprising each leaf. The axis indicated at 14 indicates a transverse direction which extends along the base 26 and the direction outward or transversely outward is referred to as a location up or down with respects to the transverse center of the frame 20 in the transverse direction.

The term "picture" is herein defined as any visual item and that a user would wish to display and includes but is not limited to photographs, drawings, or any other viewable item.

As seen in FIG. 1, the frame 20 comprises a first leaf 22, a second leaf 24, a core 26, an attachment system 28, and a hanging system 30. Each leaf comprises a first side and a second side. The core 26 runs perpendicular in a transverse axis and the leafs 22 and 24 extend outwardly in a radial axis. Leaf 22 comprises a first side 32 and a second side 34. Leaf 24 comprises a third side 36 and a fourth side 38.

Each side comprises a top portion 40, an inner portion 42, an outer portion 44, a lower portion 46, a perimeter edge 47, a central portion 48 and a photo holding portion 49. Located in the central portion is a pocket portion 50 which comprises a rim 52, a transparent sheet 54 and an open slit portion 56. The rim 52 is attached to the leaf 22 and the transparent sheet 54 is attached to the inner portion of the rim. The open slit portion 56 allows communication to the tight chamber defined by the inner surface of the transparent sheet 54 and the surface of the first leaf 22. A picture can pass through the open slit portion and be viewable through the transparent sheet 54.

The attachment system 28 can be ribbons 58 attached to the outer portion 44 of the leafs 22 and 24. The base of the ribbons 58 are positioned on the outer portion 44 in about the same vertical distance so the ribbon 58*a* can be tied to ribbon 58*b*, thereby fastening first leaf 22 to second leaf 24. Of course in the broader scope, other attachment system could be employed for instance magnets can be embedded in the outer portion 44 of the leafs 22 and 24. Alternatively, a discrete Velcro trim could be placed on the perimeter edge 47 of the first leaf 22 and an opposing Velcro trim could be placed on the perimeter edge 47 of the second leaf 24. When the perimeter edges 47 of the leafs 22 and 24 are pressed together the velcro portions will adhere to each other hold the leafs 22 and 24 together.

The hanging system 30 comprises ribbons 60. The ribbons comprise a base portion 62 and an end portion 64. End portion 64*a* is tied to end portion 64*b* in a manner to leave sufficient slack in the ribbons 60*a* and 60*b* so the frame 20 can be hung from a wall. The base portion 62*b* is fixedly positioned near the inner portion of the leaf 24. The base portion 62*a* is fixedly positioned near the end portion 44. When the leafs 22 and 24 are fastened together the base portions 62*a* and 62*b* are separated by a distance so the frame 20 can be leveled more easily.

Figure 2:
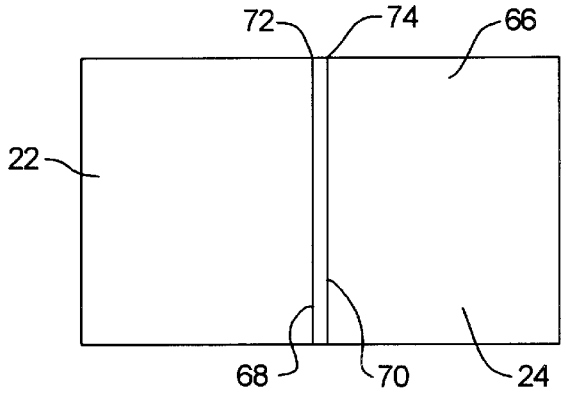
FIG. 2 is a front view of the construction process of the present invention.

In the preferred embodiment the leafs 22 and 24, the core 26 and the rims 52 are tightly covered with a fabric. As seen in FIG. 2, the construction of the core 26 and the leafs 22 and 24 can be accomplished by taking a flat piece of material 66 and running two slits 68 and 70 parallel to the transverse axis at points indicated at 70 and 74. The slits only partially cut the material 66. The vertical slits 68 and 70 act as hinge points so the leafs 22 and 24 can rotate with respects to the core 26. The material 66 can be cardboard, plastic or other material that is semi pliable. An alternative to slits, is to create a vertical indentation at points 72 and 74. This too has the effect of reducing the mass moment of inertia about the transverse axis which results in a bending action at the slits 68 and 70 when a moment about the transverse axis is applied.

Next a fabric or coating is applied around the material 66. The fabric can be glued on to the material 66. Alternatively, the material can be painted or dipped in a coloring agent substance.

Figure 3:
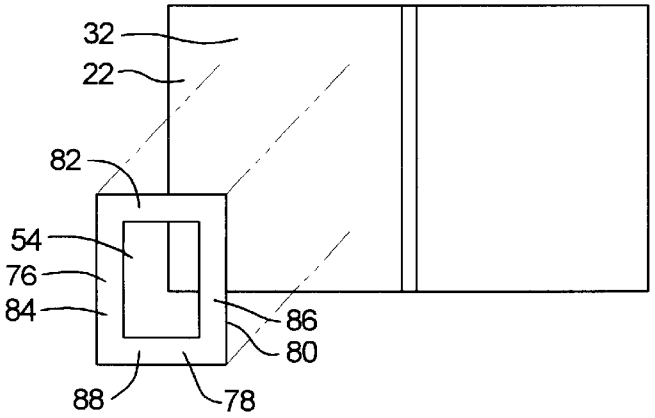
FIG. 3 is a front view of the construction process of the present invention.

As seen in FIG. 3, a rectangular frame 76 is cut to the shape shown where the center is removed. The rectangular frame 76 has a front side 78, a backside 80 and a top portion 82, side portions 84 and 86, and bottom portion 88. The rectangular frame 76 is covered in a similar manner as the material 66 and a transparent sheet 54 is attached to the backside 80. Now the rectangular frame 76 is attached to the first side 32 of leaf 22 in a manner so the side and bottom portion 88 and side portions 84 and 86 are fixed to the first side 32 of leaf 22. The top portion 82 is not attached thereby allowing access to the chamber between the transparent sheet 54 and the surface of the first side 32 of leaf 22 in order to transport a picture therein. This process is repeated for the other three sides of the frame 20.

The attachment of the ribbons 58 and 60 can be integrated into the construction process before the application of the fabric to the material 66.

Figure 4:
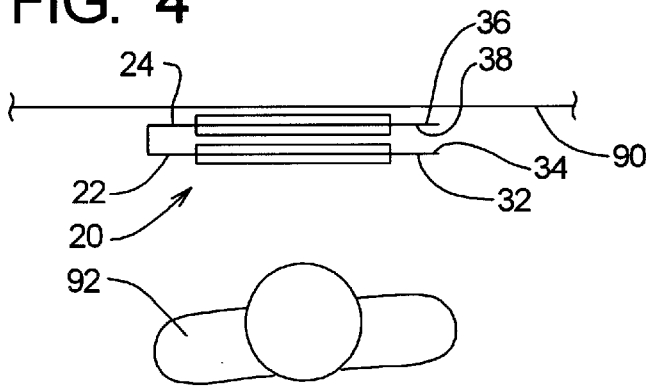
FIG. 4 is plan view of one possible configuration of the present invention.
Figure 5:
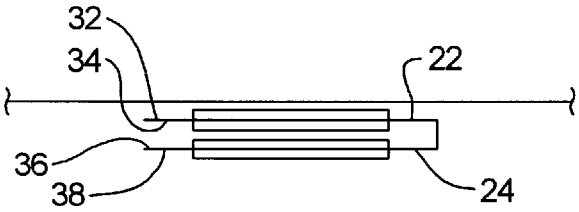
FIG. 5 is plan view of another possible configuration of the present invention.

The operation of the frame 20 is illustrated in FIGS. 4–8 which shows a plan view of the frame 20 as it would be positioned hanging from a wall 90. As seen in FIG. 4, the frame 20 is positioned in a manner such that leaf 24 is positioned near the wall herein referred to as the near position and leaf 22 is located further from the wall herein referred to as the far position. The first side 32 of first leaf 22 is visible to an observer 92; this is referred to as the visible position. So, presently the picture on the first side 32 of the first leaf 22 is in the visible position and the second side 34 of the first leaf 22, the fourth side 38 of the second leaf 24, and the third side 36 of the second leaf 24 are all in the stored positions.

It may be necessary to change the presently displayed picture. Perhaps the owner of the frame wishes to show a different picture for each of the four seasons. If the picture desired to be shown is located on the first side of the second leaf. To place this picture in the visible position the owner will rotate the frame 180 degrees about the transverse axis to the position shown in FIG. 5. Now the first side 36 of the second leaf 24 is in the visible position and the other three sides 32, 34 and 38 are in the stored position.

Figure 6:
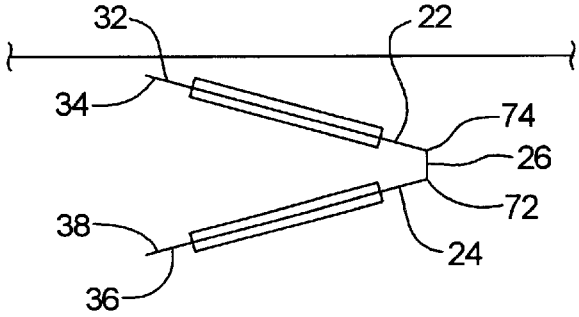
FIG. 6 is plan view of the reconfiguration process of the present invention.
Figure 7:
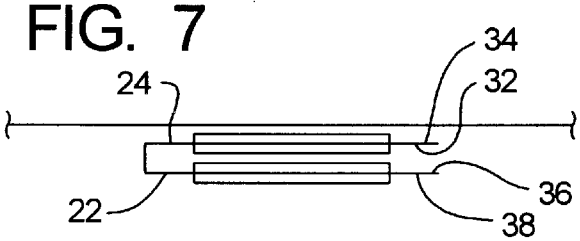
FIG. 7 is plan view of yet another possible configuration of the present invention.

If the picture desired to be displayed is on either the second side 34 or the fourth side 38, the owner will unfasten the attachment system 28 and rotate the leafs 22 and 24 about points 72 and 74 180 degrees with respects to the core 26 as shown in FIG. 6. The frame 20 is now in a position shown in FIG. 7 which looks similar to FIG. 4 except the fourth side 38 of the second leaf 24 is now in the visible position and the other three sides 32, 34 and 36 are in the stored position.

Figure 8:
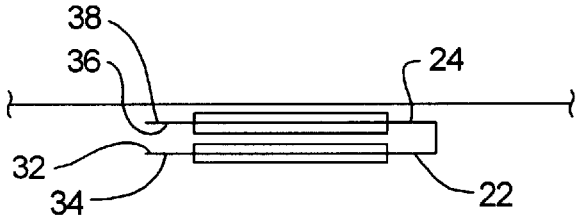
FIG. 8 is plan view of the final possible configuration of the present invention.

A further configuration of the frame 20 is shown in FIG. 8. This configuration can be obtained from the configuration in FIG. 7 by rotating the frame 20 180 degrees about the vertical axis. Now side 34 of the first leaf 22 is in the visible position.

Note that the observed thickness of the frame 20 in FIGS. 4–8 is for illustrative purposes only. The thickness of the frame 20 is relatively thin and is determined by the thickness of the material 66 and the thickness of the rectangular frames 76. The thinness of the frame 20 provides a discrete method to store pictures near the vicinity where they are to be eventually displayed.

Figure 9:
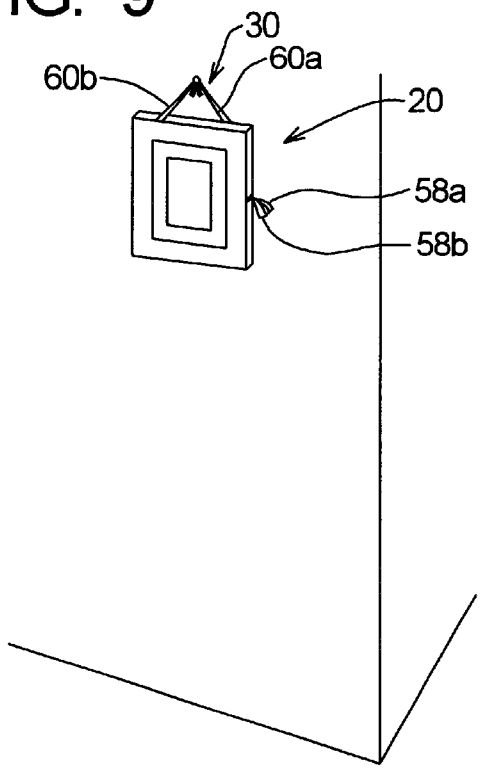
FIG. 9 is a perspective view of the preferred embodiment of the present invention.

FIG. 9 shows the frame 20 hanging on a wall. The ribbons 60 serve as a hanging system 30 and are decorative. Likewise the ribbons 58 are decorative and further serve as an attachment system to hold leafs 22 and 24 together.

Figure 10:
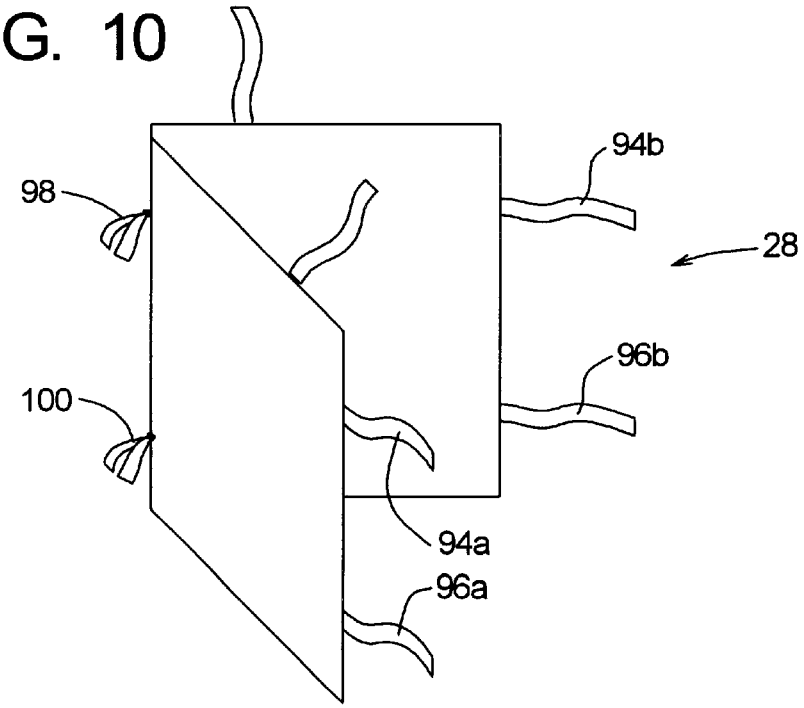
FIG. 10 is another embodiment of the present invention.

FIG. 10 shows another embodiment of the present invention where the attachment system 28 comprises two sets of ribbons 94 and 96. By placing the sets of ribbons 94 and 96 closer to the corners the a more uniform tension can be applied to the leafs 22 and 24 when each set of ribbons 94 and 96 are bound together; where ribbon 94*a* tied to ribbon 94*b* and the ribbon 96*a* is tied to ribbon 96*b*. Additionally ribbon bows 98 and 100 can be attached to the core 26 to give the frame 20 a symmetrical look where ribbon bow 98 will substantially lie in the horizontal plane with the base of ribbons 94.

Figure 11:
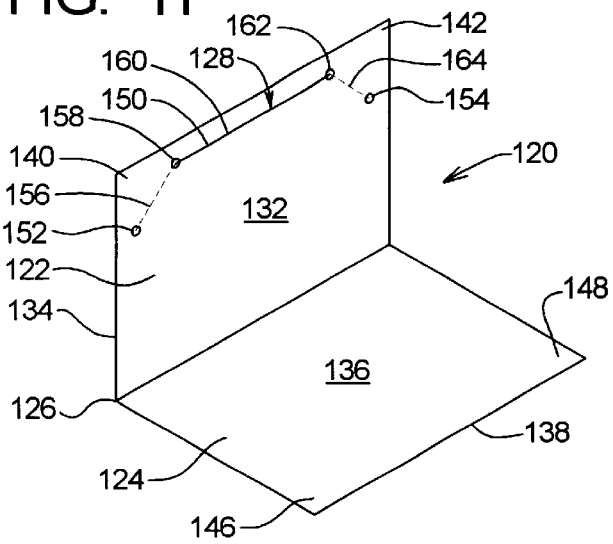
FIG. 11 is an isometric view of the second embodiment of the frame.

As shown in FIG. 11, there is another embodiment of the present invention where the frame 120 comprises a first leaf 122 a second leaf 124 and attachment system 128. The first leaf 122 comprises a first side 132 and a second side 134 and the second leaf 124 comprises a third side 136 and a fourth side 138. The first leaf 122 further has a first corner region 140 and a second corner region 142. Likewise, the second leaf 124 has a first corner region 146 and a second corner region 148. Consistent with the previous embodiments, each side is adapted to mount a picture thereon. FIGS. 11–18 are schematic figures to primarily illustrate the attachment system 128.

The attachment system 128 comprises a piece of flexible material 150 that has a first end portion 152 that is connected to the second side 134 and the flexible material further has a second end portion 154 also connected to the second side 134. The flexible material 150 further has regions that are defined as follows. A first region is indicated at 156 and is defined as the length of material 150 between the connection portion 152 and the passageway 158. A central region is indicated at 160 and is defined as the portion of flexible material 150 between the opening 158 and the opening 162. Finally, a second region indicated at 164 is defined as the length of material between the first opening 162 and the connection region 154.

Figure 12:
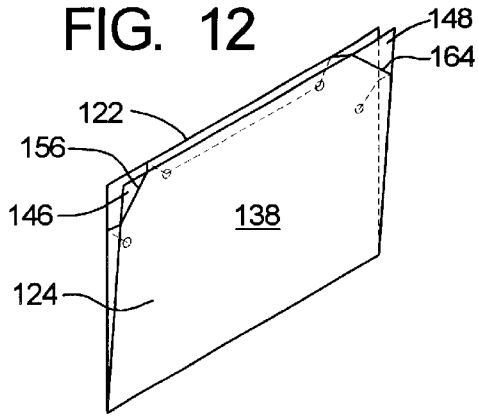
FIG. 12 is an isometric view of the frame where the attachment mechanism comprising a flexible and elastic member extends around the laterally outward and corner portions of the second leaf.

As shown in FIG. 12, the frame 120 is in a closed position where the first region 156 extends around the first corner portion 146 of the second leaf 124 and the second region 164 extends around the corner portion of the fourth side 138 and the second corner region 148 to fasten the first leaf 122 to the second leaf 124.

Figure 13:
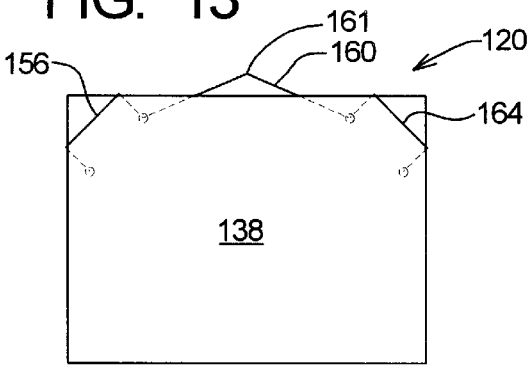
FIG. 13 is a front view of the frame illustrating how the flexible member is used to hang frame.
Figure 14:
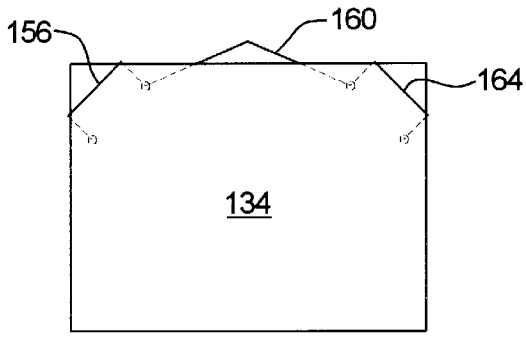
FIG. 14 is a rearview of the frame.

As shown in FIG. 13, the frame 120 can now be hung in a horizontal position where the central region 160 provides a mounting region in the center portion 161 which is adapted to extend around a stationary mounting structure such as a nail or a tack. If the user desires to display the image on the second side 134, she merely turns the frame 120 one hundred eighty degrees about a transverse axis to the position as indicated in FIG. 14. Further, if the user desires to display other side 132 or 136, she merely removes the first and second regions 156 and 164 of the flexible material 150 and rotates the second leaf 124 one hundred eighty degrees about the fold region 126 so the second and fourth sides 134 and 138 are adjacent to one another in a face to face engagement. The user then extends the first and second regions 156 and 164 around the first and second corners 146 and 148 respectively.

Figure 15:
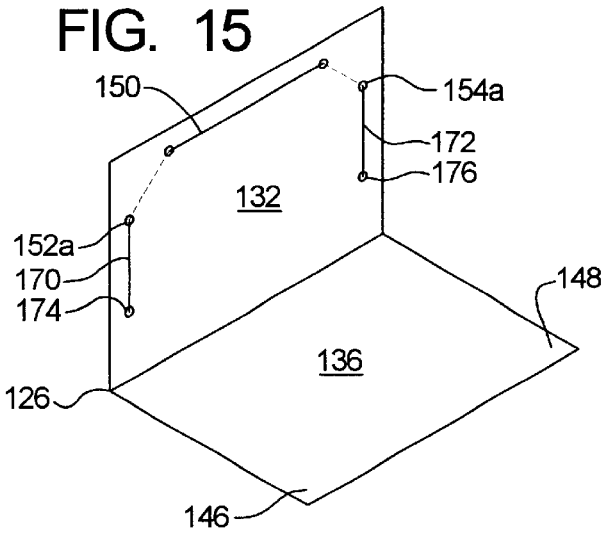
FIG. 15 is isometric view of a modification of the second embodiment where transverse members are employed extending laterally and located on the transverse ends of the first leaf.
Figure 16:
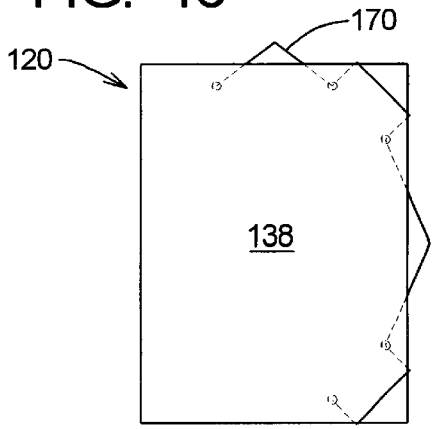
FIG. 16 is a front view illustrating how the transverse member is used to hang the apparatus.

FIG. 15 and 16 show a modification to the embodiment shown in FIGS. 11–14 where a first and second lateral member 170 and 172 is employed. The first attachment region 152 is replaced with an opening 152*a* and the flexible member extends therethrough to a connection portion 174. The first lateral member is defined as the portion of flexible material 150 between connection region 174 and opening 152*a*. Likewise, the flexible member 150 extends to the opening 154*a* to the front face portion 132 and extends to the connection region 176 and the second lateral portion 172 is defined as the portion of flexible material 150 therein between. This embodiment is advantageous because the frame member 120 as shown in FIG. 16, can be hung in a vertical alignment position where the first lateral region 170 provide support on a support (e.g. a nail).

Figure 17:
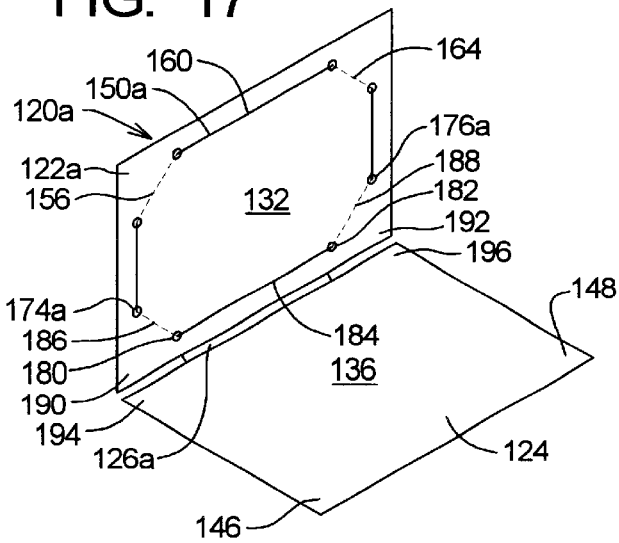
FIG. 17 is an isometric view of a third variation that the second embodiment where a continuous loop a flexible and elastic material comprises the connector mechanism.
Figure 18:
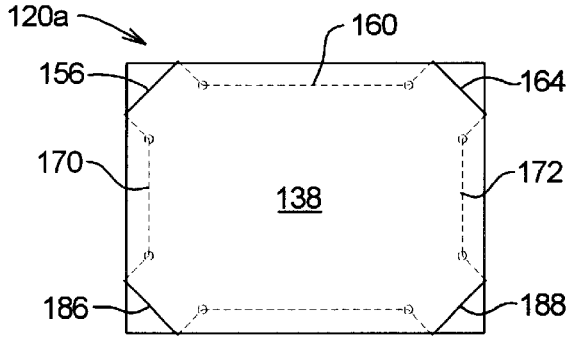
FIG. 18 is a front view of the frame illustrating how the elastic and flexible member extends around the corners to keep the two leaf members in a face to face engagement.

FIGS. 17–18 show a final embodiment where the flexible member 150*a* is a continuous loop. In this embodiment the first leaf 122*a* further comprises openings 180 and 182. A base central region 184 is defined as a portion of the flexible material 150*a* between the openings 180 and 182. Third and fourth regions 186 and 188 are defined as the portions of the flexible member 150*a* between openings 180 and 174*a* and further 182 and 176*a*. The core 126*a* extends longitudinally a distance less than that of the longitudinal length of the second leaf 124 to allow the third and fourth sections 186 and 188 to extend around the first and second interior corner portions 190 and 192. The second leaf 124 further has a third and fourth interior corner portions 194 and 196 respectively.

Therefore, as shown in FIG. 17–18, when the faces 132 and 136 are adjacent to one another the regions 156, 164, 186 and 188 extend around all of the corner portions of the first and second leaf 122*a* and 124 in a manner as shown in FIG. 18. Thereafter, the frame 120*a* can be hung by either sections 160, 170, or 172 and either faces 138 or 134 can be displayed. Alternatively, consistent with the foregoing, the sections 156, 164, 186, and 188 are removed from the respective corners of the base portion of the second leaf 124 and the leaf 124 is rotated one hundred eighty degrees about the core 126*a* with respects to the first leaf 122. Thereafter, the sections 156, 164, 186, and 188 extend around the corners 146, 148, 194, and 196 of the face 136 to hold the leafs when 122*a* and 124 are adjacent to one another. Thereafter, faces 132 and 136 are in the open position or display position and faces 134 and 138 are in the stored position. In this configuration, the base central region 184 can be used to hang the frame 120*a*.

It should be noted that the frame 120 does not have to be mounted on a wall, but rather can further be supported by its transverse outward edges on the first and second leafs 122 and 124. Alternatively, the frame 120 can rest upon the laterally outward edges of the leaf members 122 and 124.

Figure 19:
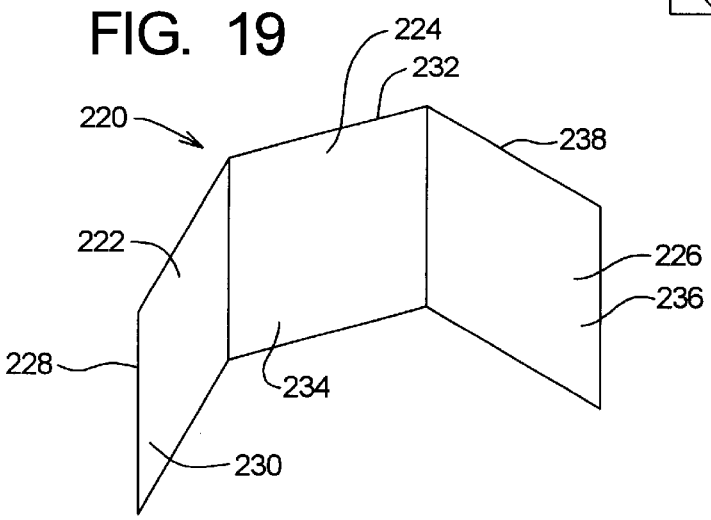
FIG. 19 is an isometric view of a fourth embodiment of the present invention.
Figure 20:
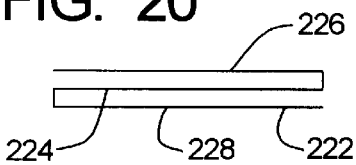
FIG. 20 is a top view of a first configuration where side six is exposed and the remaining sides are in the stored position.
Figure 21:
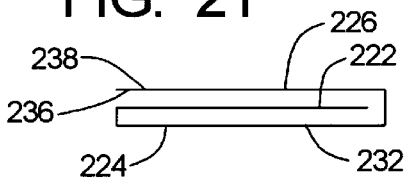
FIG. 21 is a top view of a second possible configuration where the third side is exposed and the remaining sides are in a stored configuration.

As shown in FIGS. 19–21, a third embodiment of the present invention is disclosed. The frame 220 comprises a first leaf 222, a second leaf 224 and a third leaf 226. The first leaf 222 comprises a first side 228 and a second side 230. The second leaf 224 comprises a third side 232 and a fourth side 234. Finally, the third leaf 226 comprises a fifth side 236 and a six side 238. There will now be a discussion of how the embodiment to 20 can be arranged in various configurations to store up to five pictures and display a single picture.

As shown in FIG. 20, the first leaf 222 has the first side 228 in a displayed position whereas the photos on the leafs 224 and 226 are all in a stored position. Now as shown in FIG. 21, the first leaf 222 has the photos contained thereon in a stored position and the third side 232 is in a displayed position. Finally, the fifth and six sides 236 and 238 of the third leaf 226 are in the stored position. With the foregoing in mind, it can be appreciated that any one of the sides of the leafs can be displayed while the remaining six are in stored positions. In the broader scope of the present invention a plurality of leafs can be employed that are consecutively connected at lateral regions and folded about substantially collinear axes to store photos therein.

Of course, a connection system and a hanging system can be employed with the frame 220 to keep the leaf sections adjacent to one another. The foregoing examples are illustrative where the broader scope of the invention is a frame that has the ability to store photos therein and easily change the displayed photo with little time or effort.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. A frame adapted to house a plurality of pictures where the frame comprises:

a first leaf member having a first lateral region and a second lateral region and the first leaf member comprising, a connection region located in the first lateral region, a first side adapted to mount a picture thereon, a second side adapted to mount a second picture thereon where the second side is on the opposite side of the first leaf with respect to the first side, a second leaf member having a first lateral region and a second lateral region and the second leaf member comprising, a second connection region located in the first lateral region and a second lateral region, where the second connection region is located on the first lateral region and is adapted to be pivotally mounted about the transverse axis to the connection region of the first leaf member, a third side adapted to mount a third picture thereon, a fourth side adapted to mount a fourth picture thereon where the fourth side is on the opposite side of the second leaf with respect to the third side, whereby, the frame has a first position where the first and third sides of the first and second leafs are positioned in a face to face engagement and the second lateral regions of the first and second leafs are positioned in proximity to one another and the second or fourth pictures on either the second or fourth sides are adapted to be presented and the first and third pictures are in a stored position, the frame further having a second position where the second and fourth sides of the first and second leafs are positioned in a face to face engagement and the second lateral regions of the first and second leafs are positioned in proximity to one another and the first or third pictures are adapted to be presented and the second and fourth pictures are in a stored position;

the first leaf having a first connector member and the second leaf having a second connector member, and the first connector member and the second connector member are adapted to engage one another to place the frame in the said first or second positions.

2. The frame as recited in claim 1 wherein:

the first connector and the second connector are made from a flexible material and each have a base region.

3. The frame as recited in claim 2 wherein:

the base region of the first connector is located on the first leaf at a substantially central location in the transverse direction.

4. The frame as recited in claim 2 wherein:

the base region of the second connector is located on the second leaf at a substantially central location in the transverse direction.

5. The frame as recited in claim 2 wherein:

the base region of the first connector is attached to the first leaf above a central lateral axis that is positioned at the proximate transverse center of the first leaf.

6. The frame as recited in claim 2 wherein;

the base region of the second connector is attached to the second leaf below a central axis that is positioned at the proximate transverse center of the second leaf.

7. The frame as recited in claim 2 wherein;

the base region of the second connector is attached to the second leaf below a central axis that is positioned at the proximate transverse center of the second leaf, and the first and second connector each have a connection region that each of the first and second connectors is adapted to engage the corresponding connection region of the other of the first and second connectors, and the first and second connectors function as a hanging component to mount the frame in a horizontal configuration.

8. A frame adapted to house a plurality of pictures where the frame comprises:

a first leaf member having a first lateral region and a second lateral region and the first leaf member comprising, a connection region located in the first lateral region, a first side adapted to mount a picture thereon, a second side adapted to mount a second picture thereon where the second side is on the opposite side of the first leaf with respect to the first side, a second leaf member having a first lateral region and a second lateral region and the second leaf member comprising, a second connection region located in the first lateral region and a second lateral region, where the second connection region is located on the first lateral region and is adapted to be pivotally mounted about the transverse axis to the connection region of the first leaf member, a third side adapted to mount a third picture thereon, a fourth side adapted to mount a fourth picture thereon where the fourth side is on the opposite side of the second leaf with respect to the third side, whereby, the frame has a first position where the first and third sides of the first and second leafs are positioned in a face to face engagement and the second lateral regions of the first and second leafs are positioned in proximity to one another and the second or fourth pictures on either the second or fourth sides are adapted to be presented and the first and third pictures are in a stored position, the frame further having a second position where the second and fourth sides of the first and second leafs are positioned in a face to face engagement and the second lateral regions of the first and second leafs are positioned in proximity to one another and the first or third pictures are adapted to be presented and the second and fourth pictures are in a stored position, said frame having a first transverse section, said frame further comprising a connector member having a first connection portion, a second connection portion and a central portion where the first and second connection portions are attached to the frame at the first transverse section and the central portion is adapted to be mounted to a stationary object.

9. A frame adapted to house a plurality of pictures where the frame comprises:

a first leaf member having a first lateral region and a second lateral region and the first leaf member comprising, a connection region located in the first lateral region, a first side adapted to mount a picture thereon, a second side adapted to mount a second picture thereon where the second side is on the opposite side of the first leaf with respect to the first side, a second leaf member having a first lateral region and a second lateral region and the second leaf member comprising, a second connection region located in the first lateral region and a second lateral region, where the second connection region is located on the first lateral region and is adapted to be pivotally mounted about the transverse axis to the connection region of the first leaf member, a third side adapted to mount a third picture thereon, a fourth side adapted to mount a fourth picture thereon where the fourth side is on the opposite side of the second leaf with respect to the third side, whereby, the frame has a first position where the first and third sides of the first and second leafs are positioned in a face to face engagement and the second lateral regions of the first and second leafs are positioned in proximity to one another and the second or fourth pictures on either the second or fourth sides are adapted to be presented and the first and third pictures are in a stored position, the frame further having a second position where the second and fourth sides of the first and second leafs are positioned in a face to face engagement and the second lateral regions of the first and second leafs are positioned in proximity to one another and the first or third pictures are adapted to be presented and the second and fourth pictures are in a stored position, said frame further comprising:

a first connector piece that is flexible and elastic where the first connector piece has a first mounting location, a central region, and a second mounting location, the first leaf having a first opening and a second opening adapted to allow the first connector piece to extend therethrough, whereby the first connector piece is mounted to the first leaf at a first location on the first side and the first connector piece extends through the first opening and passes through to the second side, the first piece further extends through the second opening and is mounted to the first side and a second location of the first leaf.

10. The frame as recited in claim 9 wherein;

the said first location is located transversely outward and laterally inward with respects to the said first opening, and the second location is located on the opposite transverse side of the frame and is located transversely outward and laterally inward with respects to the said second opening.

* * * * *